US005775350A

United States Patent [19]

Akanuma et al.

[11] Patent Number: 5,775,350

[45] Date of Patent: Jul. 7, 1998

[54] RUNNING WATER TYPE WASHING MACHINE

[75] Inventors: Shigeo Akanuma; Masashi Fujii, both of Ayase, Japan

[73] Assignee: Speedfam Clean System Co., Ltd., Ayase, Japan

[21] Appl. No.: 714,396

[22] Filed: Sep. 16, 1996

[30] Foreign Application Priority Data

Feb. 14, 1996 [JP] Japan ..... 8-050951

[51] Int. Cl.[6] ..... B08B 3/04

[52] U.S. Cl. ..... 134/183; 134/902

[58] Field of Search ..... 134/154, 182, 134/183, 186, 902

[56] References Cited

FOREIGN PATENT DOCUMENTS

| | | | |
|---|---|---|---|
| 61-130389 | 8/1986 | Japan . | |
| 64-63086 | 3/1989 | Japan . | |
| 182943 | 7/1993 | Japan | 134/902 |

*Primary Examiner*—Philip R. Coe

*Attorney, Agent, or Firm*—Oblon, Spivak, McClelland, Maier & Neustadt, P.C.

[57] ABSTRACT

A flow regulation means 7 for a wash liquid 5 is constituted by first and second regulator plates 11 and 12 in the form of perforated plates and a third regulator plate 13 in the form of a fibrous plate, the first to third regulator plates 11 to 13 being successively located in spaced positions from upstream to downstream side.

6 Claims, 3 Drawing Sheets

RUNNING WATER TYPE WASHING MACHINE

BACKGROUND OF THE INVENTION

1. Field of the Art

This invention relates to a running water type washing machine suitable for precision wash of work which requires a high degree of cleanliness like semiconductor wafers, magnetic disk substrates or other electronic parts, optical parts, precision mechanical parts etc.

2. Prior Art

Various running water type washing machines, which are designed to wash work in a submerged state under uniform streams of a wash liquid, have thus far been known in the art, for example, from Laid-Open Japanese Utility Model Specification S61-130389 and also from Laid-Open Japanese Patent Specification S64-63086.

In a washing machine of this sort, for the purpose of preventing detached contaminant substances from being entrained on turbulent wash liquid flows and brought back to re-deposit on work, it has been the general practice to provide a porous flow regulator plate across a channel-like flow passage of a wash liquid, passing the wash liquid therethrough to regulate same into turbulence-free uniform streams (a laminar flow).

Normally, the flow regulator plate is constituted by a perforated plate containing a multitude of water passage apertures of a circular or elongated slot-like shape, and located either on an upstream side of a flow passage or on both of upstream and downstream sides of a flow passage.

According to experiments of flow regulation conducted by the inventors, it has been found that flow regulating effects of a single or a plural number of perforated flow regulator plates, which are simply set in a flow passage of a washing machine, are no more than just imparting a certain directionability to a wash liquid flow while suppressing turbulent flows to some extent, giving rise to difficulties in regulating the wash liquid into a uniform laminar flow as required in precision washing.

These difficulties are considered to be attributable partly to the small thickness of the regulator plate or plates and partly to the nature of water passage apertures which are straightforwardly opened in each regulator plate at predetermined intervals, failing to suppress diffusive movements of the wash liquid at the exit side of the flow regulator plate.

As a result of an extensive research on wash liquid flow regulation in a running water type washing machine, the inventors have succeeded in producing excellent flow regulating effects especially by the use of a combination of a perforated regulator plate and a fibrous regulator plate.

SUMMARY OF THE INVENTION

It is a primary object of the present invention to provide a running water type washing machine of the class as mentioned hereinbefore, which is capable of forming a laminar flow of a wash liquid in an assured manner by the use of a flow regulator means which has excellent effects of flow regulation.

It is another object of the present invention to provide a running water type washing machine which permits easy maintenance and service including replacements and cleaning of flow regulator plates.

In accordance with the present invention, in order to achieve the objectives as mentioned above, there is provided a running water type washing machine which comprises, in the flow passage of a wash liquid, a flow regulation means employing at least one perforated flow regulator plate having a multitude of water passage apertures in combination with at least one fibrous flow regulator plate positioned on the downstream side of the perforated flow regulator plate.

With a running water type washing machine with the above-described flow regulation means according to the invention, a wash liquid, which is supplied from a liquid feed section still in a turbulent state, is firstly passed through the perforated regulator plate thereby absorbing turbulences and imparting a directionability to form an almost uniform flow with equalized flow velocity in upper and lower layers, and then passed through the fibrous flow regulator plate which is capable of more strictly limiting diffusive movements of the wash liquid and of more exquisitely fine flow regulation to send the wash liquid to an ensuing washing section in a laminar flow suitable for precision washing.

According to one specific embodiment of the invention, the flow regulation means is composed of a couple of perforated flow regulator plates, namely, first and second perforated regulator plates and a third fibrous regulator plate, which are located successively in spaced positions in that order from upstream to downstream side of the flow regulation means.

In this instance, desirably the two perforated regulator plates are arranged to have different water passage areas in such a way that the first perforated regulator plate which is located upstream of the second perforated regulator plate has a smaller water passage area than the latter.

By so arranging, it becomes possible for the flow regulation means to prevent propagation of turbulences to the downstream side and at the same time to impart a certain degree of directionability to the wash liquid flow by means of the first regulator plate with a smaller total water passage area, and thereafter to moderate and more equalize flow velocities of upper and lower layers by means of the second flow regulator with a larger total water passage area.

Although the water passage apertures in the above-described first and second flow regulator plates may be formed in any arbitrary shapes, but they are preferred to be in the form of horizontally oriented slots. In the case of slots, it is desirable that individual slots are formed in the same shape and size in both of the first and second flow regulator plates, except that they are preferred to be formed at greater intervals or in a greater pitch in the first regulator plate than in the second regulator plate to vary the total water passage area.

In a preferred form of the present invention, the flow regulation means is provided in the form of a module unit which retains the respective regulator plates in predetermined spaced positions on a holder frame and which can be removably mounted in position on a washing vessel of the machine.

Accordingly, the maintenance and service of the flow regulation means becomes extremely easy, including replacements and cleaning of the respective regulator plates.

The above and other objects, features and advantages of the invention will become apparent from the following description and the appended claims, taken in conjunction with the accompanying drawings which show by way of example some preferred embodiments of the invention.

DESCRIPTION OF PREFERRED EMBODIMENTS

Hereafter, the present invention is described more particularly by way of its preferred embodiments with reference to the accompanying drawings.

Figure 1:
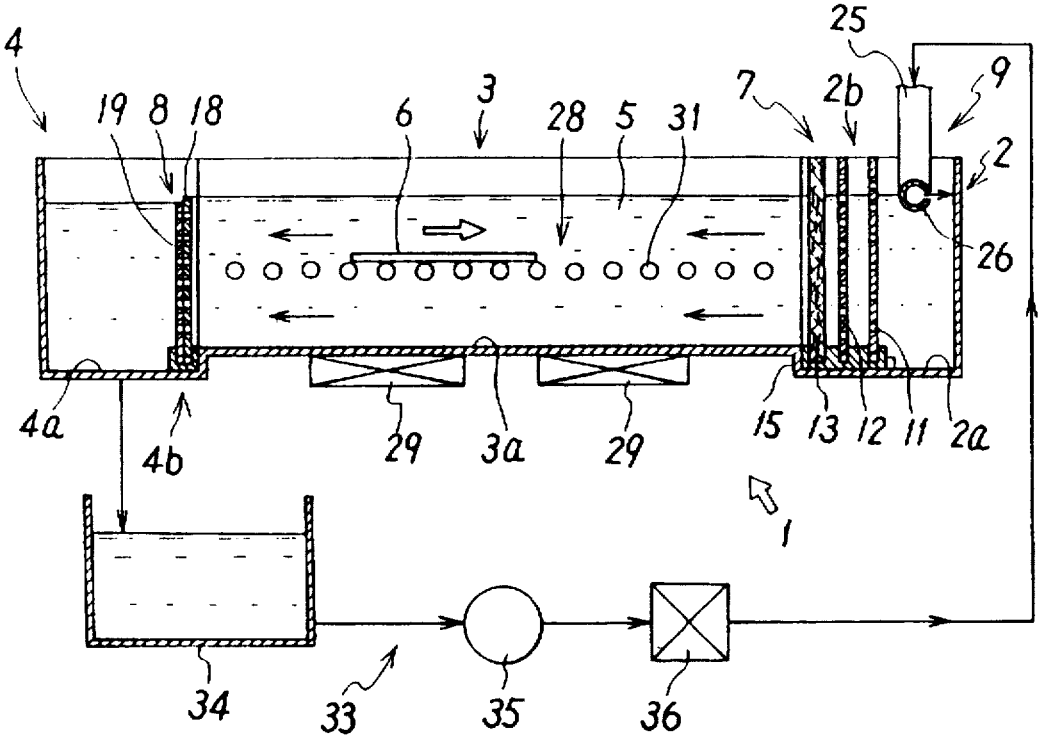
FIG. 1 is a schematic vertical section of a running water type washing machine embodying the present invention.
Figure 2:
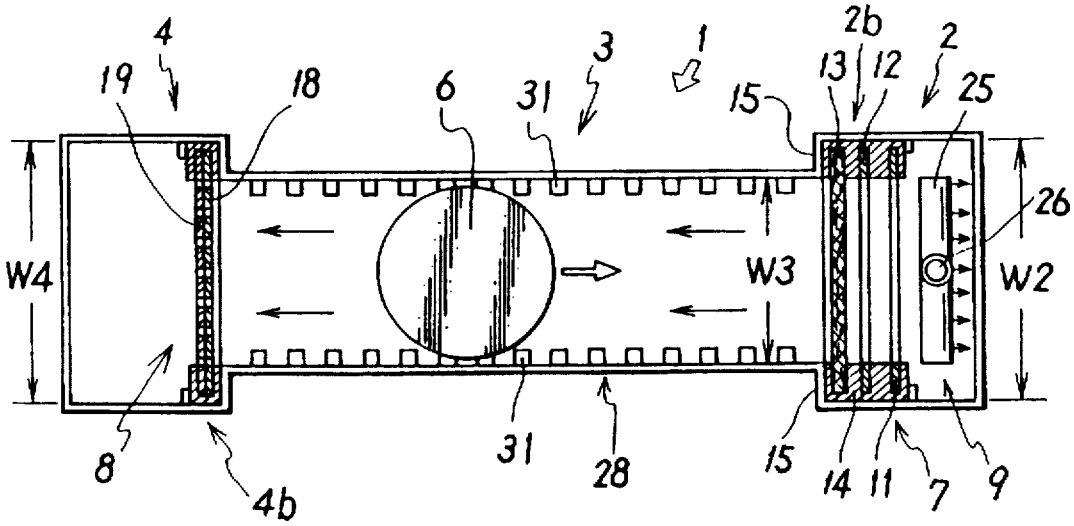
FIG. 2 is a partly section plan view of the washing machine of FIG. 1.
Figure 3:
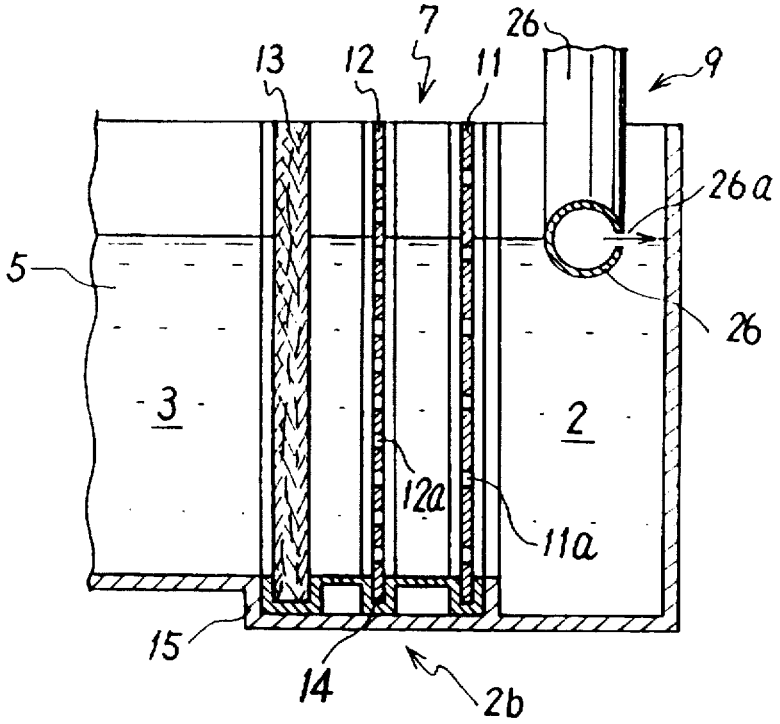
FIG. 3 is an enlarged fragmentary view of major components of the machine shown FIG. 1.
Figure 4:
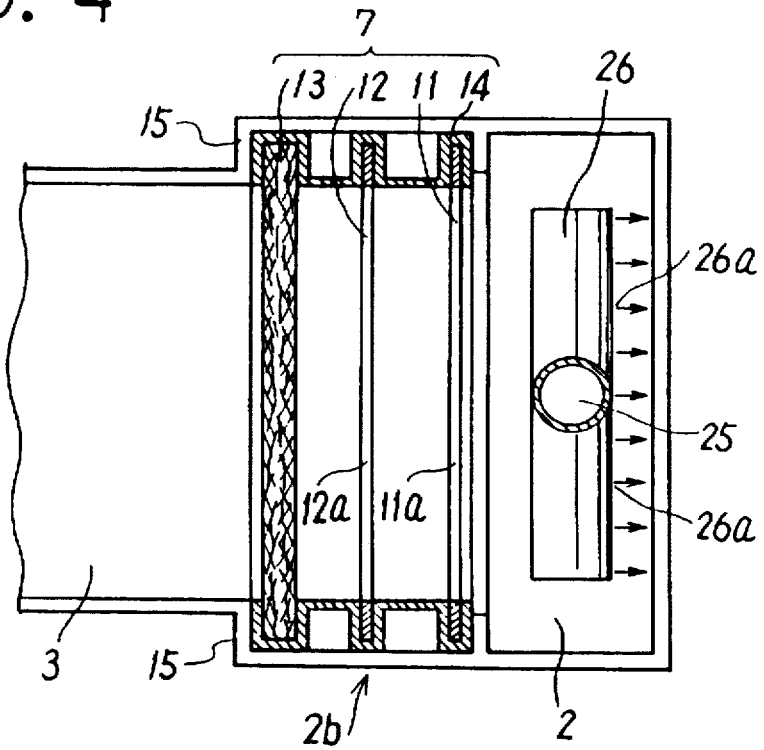
FIG. 4 is an enlarged fragmentary view of major components of the machine shown in FIG. 2.

Referring to FIGS. 1 and 2, there is shown an embodiment of the running water type washing machine according to the present invention, having a washing vessel 1 of the so-called lateral flow type which is arranged to wash work 6 in a wash liquid flowing in a lateral direction through and along a water passage in the washing vessel at a moderate or low velocity (e.g., at about 10 mm to 20 mm/sec).

The washing vessel 1 includes a liquid feed section 2 which supplies a wash liquid such as pure or ultra-pure water, chemical treatment liquid or the like, a liquid discharge section 4 which discharges spent wash liquid to the outside, and a washing section 3 which is provided between the liquid feed section 2 and the liquid discharge section 4 and in which a work 6 is washed in a submerged state in a wash liquid 5 flowing from the liquid feed section 2 to the liquid discharge section 4.

The above-mentioned liquid feed section 2 and the liquid discharge section 4 of the washing vessel 1 are formed in broader widths W2 and W4, respectively, as compared with the intermediate washing section 3 with a width W3. In addition, the liquid feed section 2 and the liquid discharge section 4 are formed deeper than the intermediate washing section 3, with bottom levels 2*a* and 4*a* which are sunken or stepped down from a bottom level 3*a* of the intermediate washing section 3 of predetermined width and depth.

Provided in part of the liquid feed and discharge sections 2 and 4 are flow regulator mount portions 2*b* and 4*b*, respectively, for installation of flow regulation means 7 and 8 which regulate the wash liquid into uniform streams.

A liquid feeder means 9 is provided in the liquid feed section of the vessel 1 at a position upstream of the above-mentioned flow regulation means 7 for supply of the wash liquid 5.

The upstream flow regulation means 7 on the side of the liquid feed section 2 is composed of a couple of perforated flow regulator plates 11 and 12 and a fibrous flow regulator plate 13. More specifically, the first regulator plate 11 and the second regulator plate 12, which is located immediately on the downstream side of the first regulator plate 11, are each in the form of a metallic or ceramic perforated plate with a multitude of water passage apertures 11*a* or 12*a*, while the third regulator plate 13, which is located downstream of the second regulator plate 12, is in the form of a fibrous plate of nylon, polyester or other synthetic fiber.

Figure 5:
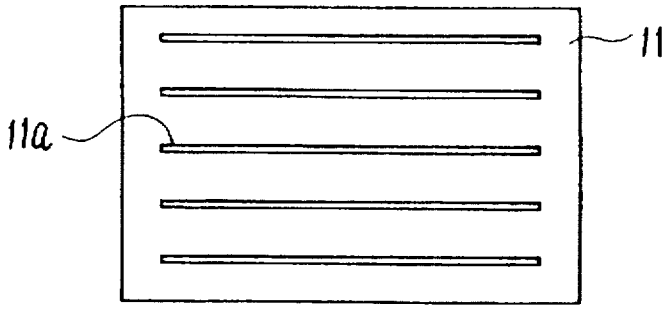
FIG. 5 is a front view of a first flow regulator plate of a flow regulation means to be installed in a liquid feed section of the machine.
Figure 6:
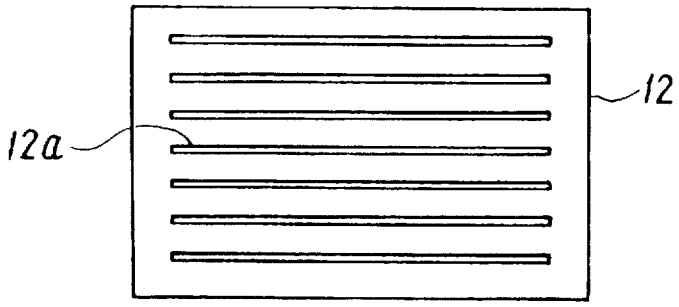
FIG. 6 is a front view of a second flow regulator plate of the flow regulation means to be installed in the liquid feed section.

As shown particularly in FIGS. 5 and 6, the water passage apertures 11*a* and 12*a* opened in the first and second flow regulator plates 11 and 12 are in the form of horizontally oriented slots which are all identical in shape and size. However, the water passage apertures 11*a* in the first regulator plate 11 are opened at greater intervals or in a greater pitch than the water passage apertures 12*a* in the second regulator plate 12. As a consequence, the first regulator plate 11 has a smaller total water passage area than the second regulator plate 12.

It is to be understood that the water passage apertures 11*a* and 12*a* in the first and second regulator plates 11 and 12 may be formed in any other arbitrary shape or size or may be of different shapes. Further, instead of the horizontally oriented slots employed in the particular embodiment shown, the perforated regulator plates may employ water passage apertures of a circular or polygonal shape. Alternatively, water passage apertures of different shapes and sizes may be used in combination for one flow regulator plate. In case the water passage apertures are in the form of elongated slots, for example, horizontally oriented slots and vertically oriented slots may be used for the two perforated regulator plates, respectively.

In short, the water passage apertures in the first and second regulator plates 11 and 12 may be of any shape or size as long as the two plates can produce favorable flow regulation effects and have different total water passage areas as described hereinbefore.

The fibrous plate for the third flow regulator plate 13 is preferred to be non-woven fabric or similar fibrous material which can pass the wash liquid at a suitable flow velocity, and which is resistant to the wash liquid and completely free from dust generation. For example, fibrous material which is commercially available as filters for air-conditioners of building and factories can be suitably employed. Further, the third regulator plate 13 may be formed in a flat shape or in a pleated or corrugated shape.

In contrast to the first and second flow regulator plates 11 and 12 in the form of thin perforated plates each containing a multitude of straightforward water passage apertures at predetermined intervals, the third regulator plate 13 is relatively thick and contains numerous narrow water passage interstices between individual fine fibrous filaments which are complicatedly overlapped and intertwined in high density. Therefore, upon passage through the third fibrous regulator plate 13, the wash liquid 5 is regulated into uniform streams by suppression of diffusive movements. In this regard, it has been experimentally proved that excellent flow regulating effects can be obtained by using the fibrous flow regulator plate 13 of the above-described nature in combination with and on the downstream side of the first and second perforated flow regulator plates 11 and 12.

More specifically, in the above-described flow regulation means 7, firstly the wash liquid 5, which is still in a turbulent state when coming out of the liquid feeder means 9, is successively passed through the first and second flow regulator plates 11 and 12 thereby absorbing turbulences in the wash liquid while at the same time imparting thereto a certain degree of directionability to form an almost uniform flow which is equalized in flow velocity of upper and lower layers. Then, the wash liquid is passed through the third regulator plate 13 of fibrous material which further restricts diffusive movements of the wash liquid to send it to the washing section 3 in uniform laminar streams.

In this instance, by differentiating the pitch of water passage apertures, the first regulator plate 11 is arranged to have a smaller total water passage area than the second regulator plate 12, so that the wash liquid can be efficiently regulated into a uniform flow by the actions of the two regulator plates, firstly blocking propagation of turbulences to the downstream side and imparting a certain degree of directionability by the first regulator plate 11 with a smaller total water passage area and nextly moderating and equalizing flow velocities of upper and lower layers through the second regulator plate 12 with a larger total water passage area. This also contributes to enhance the flow regulating effects of the third regulator plate 13 in the last stage all the more.

Preferably, the flow regulation means 7 is provided in the form of a flow regulation module unit which retains the respective regulator plates 11 to 13 replaceably in predetermined spaced positions on a holder frame 14 of a closed rectangular shape or of an open-topped U-shape. The flow regulation unit is removably installed in the above-mentioned regulator mount portion **2*b* of the liquid feed section 2, with the holder frame 14 in abutting engagement with the stepped portion 15 at the border between the liquid feed section 2 and the washing section 3 in such a way that only perforated portions of the respective regulator plates 11 to 13 are disposed in the flow passage to the ensuing washing section 3**.

Consequently, the flowing wash liquid 5 can be regulated into uniform laminar streams in an assured manner without being disturbed by the holder frame 14 which is located behind the stepped portion bordering on the wash section 3.

Besides, the module unit of the flow regulation means 7 can be easily mounted or dismantled on and off the liquid feed section 2 at the time of replacements of the respective regulator plates or when it becomes necessary to clean the washing vessel 1 or the flow regulation means 7 itself, thus making the maintenance and service of the washing machine extremely easy.

Although the first and second regulator plates 11 and 12 are perforated to have different total water passage areas for the purpose of producing a higher degree of flow regulation effects, one can obtain adequate flow regulation effects even if the two perforated regulator plates are arranged in the same construction with the same total water passage area.

On the other hand, the downstream flow regulation means 8 on the side of the liquid discharge section 4 is constituted by a couple of perforated metal plates 18 and 19 each containing a multitude of water passage apertures. These flow regulator plates 18 and 19 are set at such a height that part of the wash liquid 5 is allowed to overflow through the top of each regulator plate.

The two regulator plates 18 and 19 are located in position across the flow passage of the wash liquid in an overlapped state and at the same time in a relatively adjustable state in the vertical direction, so that the overlapping conditions of perforations in these two regulator plates can be varied by moving one regulator plate vertically into and out of the flow passage of the wash liquid for adjustments of the open water passage area of the downstream flow regulation means 8 whenever there arises a necessity for adjusting flow velocities of upper and lower layers of the wash liquid 5.

However, in the present invention, the downstream flow regulation means 8 may be arranged in any form other than the particular example shown above.

The liquid feeder means 9 in the liquid feed section of the washing vessel 1 includes a horizontal spout pipe 26 at the lower end of a conduit 25 which is connected to a wash liquid source, not shown. The spout pipe 26 is provided with a plural number of spout holes **26*a* along its lateral side and so positioned as to spout the wash liquid 5 at a level substantially same as the surface level of the wash liquid 5 in the liquid feed section 2**.

Similarly, the arrangement of the liquid feeder means 9 is not restricted to the particular example shown.

Further, preferably the washing section 3 of the washing vessel 1 is provided with a transfer means 28 to transfer work 6 from its downstream end to upstream end in the counter-flow direction and in a submerged state under streams of the wash liquid 5, and at least one ultrasonic radiation means 29 to enhance the washing effects by application of ultrasound energy.

As shown in the drawing, the transfer means 28 can be constituted by a roller conveyer consisting of a plural number of rollers which are rotatably supported at predetermined intervals on and along the opposite side walls of the washing section 3 and adapted to be driven from an electric motor, not shown, to transfer the work 6 in a horizontally supported state in the counter-flow direction. However, the transfer means 28 is not restricted to the particular example shown, and may be arranged to transfer the work 6 in a vertical position on a support moving parallel with the streams of the wash liquid 5.

For the purpose of recycling used wash liquid, it is desirable to provide a recycling circuit 33 between the liquid feed section 2 and the liquid discharge section 4, including a reservoir tank 34 for collecting effluent wash liquid 5 from the discharge section 4, a pump 35 for sending the wash liquid 5 back to the liquid feed section 2, and a filter 36 for cleaning the recycling wash liquid 5.

In the washing machine of the above-described arrangements, the flow of the wash liquid 5, which is fed to the liquid feed section 2 through the spout pipe 26 of the liquid feeder means 26, is regulated into uniform streams as it is successively passed through the first to third regulator plates 11 to 13 of the upstream flow regulator means 7 on its way to the washing section 3. On the other hand, at the downstream flow regulation means 8, the wash liquid is passed through the regulator plates 18 and 19 and discharged to the outside along with part of the wash liquid 5 flowing into the discharge section 4 over these regulator plates. In case the washing machine includes above-described recycling circuit 33, the effluent wash liquid 5 is cleaned by filtration prior to recirculation to the liquid feed section 2.

In operation, the work 6 to be washed is put on the roller conveyer 31 at the downstream end of the washing section 3 by a loading means, not shown, and transferred toward the upstream end in the counter-flow direction while undergoing washing actions by the wash liquid 5. The washed work is picked up out of the washing vessel 1 at the upstream end of the washing section by an unloading means which is also not shown.

Contaminant substances detached from the work 6 are carried away from the latter, entrained on the streams of the wash liquid 5, and discharged from the liquid discharge section 4 without being allowed to re-deposit on the work 6.

In the above-described embodiment, the upstream flow regulation means 7 is constituted by two perforated regulator plates and one fibrous regulator plate. Nevertheless, it may be arranged to include one or more than two perforated regulator plates or two or more fibrous regulator plates which are of the same or different properties in porosity or water permeability.

In short, the flow regulating effects as aimed by the present invention can be obtained by means of a flow regulator employing a fibrous flow regulator plate in combination with and on the downstream side of a perforated regulator plate.

What is claimed is:

1. A running liquid washing machine, comprising:

a washing vessel including a liquid feed section, a liquid discharge section and a washing section arranged between said liquid feed section and said liquid discharge section such that a work is washed in said washing section by a wash liquid flowing from said liquid feed section to said liquid discharge section via said washing section; and a flow regulator provided in said liquid feed section in order to regulate a flow of the wash liquid toward said washing section and including at least one perforated flow regulator plate and at least one fibrous flow regulator plate, said at least one perforated flow regulator plate having plural liquid passage apertures, said at least one fibrous flow regulator plate being provided downstream of said at least one perforated flow regulator plate along the flow of the wash liquid.

2. A running liquid washing machine as defined in claim 1, wherein said flow regulator has a first perforated flow regulator plate and a second perforated flow regulator plate provided downstream of said first perforated flow regulator plate along the flow of the wash liquid.

3. A running liquid washing machine as defined in claim 2, wherein said first perforated flow regulator plate has a smaller total area of the plural liquid passage apertures than that in said second perforated flow regulator plate.

4. A running liquid washing machine as defined in claim 3, wherein the plural liquid passage apertures have forms of horizontally extending slots with same shapes and sizes, and said first perforated flow regulator plate has larger spans between the plural liquid passage apertures than those in said second perforated flow regulator plate.

5. A running liquid washing machine as defined in claim 2, wherein the plural liquid passage apertures have forms of horizontally extending slots.

6. A running liquid washing machine as defined in claim 1, wherein said flow regulator is provided in a form of a module unit which is adapted to be removably mounted in said liquid feed section, and said module unit includes a holder frame adapted to retain said at least one perforated flow regulator plate and said at least one fibrous flow regulator plate in separate positions.

* * * * *